US011313255B2

(12) United States Patent
Laycock

(10) Patent No.: US 11,313,255 B2
(45) Date of Patent: Apr. 26, 2022

(54) MARINE OUTBOARD MOTOR WITH VALVE TRAIN HAVING ADJUSTABLE LASH

(71) Applicant: COX POWERTRAIN LIMITED, Shoreham-By-Sea (GB)

(72) Inventor: Adam Laycock, Shoreham-by-Sea (GB)

(73) Assignee: COX POWERTRAIN LIMITED, Shoreham-By-Sea (GB)

( * ) Notice: Subject to any disclaimer, the term of this patent is extended or adjusted under 35 U.S.C. 154(b) by 55 days.

(21) Appl. No.: 16/796,094

(22) Filed: Feb. 20, 2020

(65) Prior Publication Data

US 2020/0284171 A1 Sep. 10, 2020

(30) Foreign Application Priority Data

Mar. 7, 2019 (GB) ..... 1903076

(51) Int. Cl.
*F01L 1/18* (2006.01)
*F01L 1/20* (2006.01)
*B63H 20/00* (2006.01)

(52) U.S. Cl.
CPC ..... *F01L 1/205* (2013.01); *F01L 1/185* (2013.01); *B63H 20/00* (2013.01)

(58) Field of Classification Search
CPC ... F01L 1/205; F01L 1/185; F01L 1/08; F01L 3/08; F01L 2800/17; F01L 2305/00;
(Continued)

(56) References Cited

U.S. PATENT DOCUMENTS 4,502,428 A * 3/1985 Paar ..... F01L 1/2411 123/90.46
4,539,952 A 9/1985 Nouno et al.
(Continued)

FOREIGN PATENT DOCUMENTS

DE 102016210401 5/2017
EP 0849437 6/1998
(Continued)

OTHER PUBLICATIONS

Search Report & Written Opinion issued in Int'l Appl. No. PCT/GB2020/050515 (dated 2020).
(Continued)

*Primary Examiner* — Zelalem Eshete
(74) *Attorney, Agent, or Firm* — Barnes & Thornburg LLP

(57) ABSTRACT

A marine outboard motor having an internal combustion engine is provided. The internal combustion engine includes an engine block having at least one cylinder and a valve train comprising a cam, a valve assembly including a valve spring, a roller finger follower, and a pivot post. The pivot post extends from a fixed body of the engine block and defines a contact surface about which the roller finger follower pivots when deflected by the cam during use. The pivot post is moveable relative to the fixed body in a first longitudinal direction (A) against the action of the valve spring. A removable shim is disposed between the fixed body and a portion (182) of the pivot post to space the pivot post from the fixed body in the first longitudinal direction (A) and thereby reduce an amount of lash between the cam and the roller finger follower. The removable shim is dimensioned to fit at least partly around a shaft portion of the pivot post.

11 Claims, 5 Drawing Sheets

(58) Field of Classification Search
CPC ..... F01L 2001/0535; B63H 20/00; F02B 61/045; F02B 75/007
See application file for complete search history.

(56) References Cited

U.S. PATENT DOCUMENTS

| | | | | |
|---|---|---|---|---|
| 8,985,076 | B1 | 3/2015 | Kim et al. | |
| 2008/0216784 | A1 | 9/2008 | Himsel et al. | |
| 2009/0188457 | A1* | 7/2009 | Fujii | F01L 1/2405 123/90.55 |
| 2016/0003111 | A1* | 1/2016 | Evans | F01L 1/205 123/90.45 |

FOREIGN PATENT DOCUMENTS

| | | |
|---|---|---|
| GB | 963995 | 7/1964 |
| GB | 2532014 | 5/2016 |
| JP | 2006/336655 | 12/2006 |

OTHER PUBLICATIONS

Search and Examination Report issued in GB1903076.6 (dated 2019).

* cited by examiner

MARINE OUTBOARD MOTOR WITH VALVE TRAIN HAVING ADJUSTABLE LASH

CROSS REFERENCE TO RELATED APPLICATIONS

This application claims priority to United Kingdom patent application no. 1903076.6, filed Mar. 7, 2019. The disclosure set forth in the referenced application is incorporated herein by reference in its entirety.

TECHNICAL FIELD

The present invention relates to a marine outboard motor having an internal combustion engine with a valve train comprising a cam and a roller finger follower and having adjustable lash.

BACKGROUND

At present, the outboard engine market is dominated by petrol engines. Petrol engines are typically lighter than their diesel equivalents. However, a range of users, from military operators to super-yacht owners, have begun to favour diesel outboard motors because of the improved safety of diesel fuel, due to its lower volatility, and to allow fuel compatibility with the mother ship. Furthermore, diesel is a more economical fuel source with a more readily accessible infrastructure for marine applications.

To meet current emissions standards, modern diesel engines for automotive applications typically use sophisticated charge systems, such as direct cylinder injection and turbocharging, to improve power output and efficiency relative to naturally aspirated diesel engines. With direct injection, pressurised fuel is injected directly into the combustion chambers. This makes it possible to achieve more complete combustion resulting in better engine economy and emission control. Turbocharging is commonly known to produce higher power outputs, lower emission levels, and improved efficiency compared to normally aspirated diesel engines. In a turbocharged engine, pressurised intake air is introduced into the intake manifold to improve efficiency and power output by forcing extra amounts of air into the combustion chambers. Turbocharged diesel engines typically take up more space than their normally aspirated equivalents. While this is generally not a problem in automotive applications, where there is often ample room for turbochargers in the engine bay, it can be problematic with marine outboard motors, in which the available space under the cowl can be extremely limited. Although particularly acute with turbocharged engines, the problem of limited packaging space can be an issue with all types of marine outboard motor irrespective of the fuel type.

For internal combustion engines which include a valve train having one or more cams and one or more roller finger followers, it is important to ensure that lash in the valve train is at an appropriate level to avoid unnecessary fuel consumption and emissions during use. Lash can be characterised as the basic clearance between the cam surface and the roller finger follower when the respective valve is seated closed and is necessary to compensate for changes in length of components in the valve train due to heat expansion during use or due to wear. If the clearance is too small, the valves may not seat properly. If the clearance is too large, the ramp sections of the cam profile, which are designed to gently open and close the valve, can be bypassed, resulting in more sudden valve opening and closing when the cam and roller finger follower come into contact at a steeper section of the cam profile. This can cause noise and excessive loading and wear of valve train components.

To ensure the correct lash, it is known to shim the tip of the valve stem to compensate for variations in manufacturing tolerances and due to setting or wearing processes. This needs to be checked periodically through the life of the engine and usually involves an iterative process of trial and measurement using different thickness shims. While this is an effective means by which the correct lash can be set, it is a time consuming process which typically requires removal of the cam shafts to gain access to the valve stems and valve spring assembly and can lead to the loss of components, such as spring collets, during service. The loss of components can be particularly problematic with marine outboards, since the engine is typically vertically orientated with the valve train hung out over the rear of the vessel as installed.

The present invention seeks to provide a marine outboard motor which overcomes or mitigates one or more problems associated with the prior art.

SUMMARY OF THE INVENTION

According to a first aspect of the present invention, there is provided a marine outboard motor having an internal combustion engine comprising an engine block having at least one cylinder and a valve train comprising a cam, a valve assembly including a valve and a valve spring configured to bias the valve towards a closed position, a roller finger follower having a valve end and a pivot end, and a pivot post extending from a fixed body of the engine block at the pivot end of the roller finger follower, the pivot post defining a contact surface about which the roller finger follower pivots when deflected by the cam during use, wherein the pivot post is moveable relative to the fixed body in a first longitudinal direction against the action of the valve spring, and wherein a removable shim is disposed between a bearing surface of the fixed body and a portion of the pivot post to space the pivot post from the fixed body in the first longitudinal direction and thereby reduce an amount of lash between the cam and the roller finger follower.

With this arrangement, the lash can be adjusted simply by manually moving the pivot post in the first direction to lift the roller finger follower as installed in the engine and thereby compress the valve spring safely. A removable shim with a different thickness can then be inserted between the pivot post and the fixed body to ensure the correct amount of lash. This means that lash can be adjusted easily without the need to remove any valve train parts to order to gain access the valve assembly. This can be particularly beneficial for internal combustion engines for which there is little or no service access to the valve assembly. When released, the pivot post sits down on the shim and locks it in place. With the claimed arrangement, there is no need to re-time the engine and there is no need to provide threaded adjusters or lock nuts.

The shim may be positioned between any suitable part of the pivot post and the bearing surface of the fixed body. For example, the removable shim may be positioned against an end surface of the removable shim. Preferably, the removable shim is dimensioned to fit at least partly around a shaft portion of the pivot post. The removable shim may be dimensioned to fit at least partly around a shaft portion of the pivot post such that a clearance exists between the removable shim and the shaft portion. The removable shim may be dimensioned to fit tightly around a shaft portion of the pivot post.

Preferably, the removable shim has an open shape. The open shape may be configured to allow the removable shim to be positioned around the shaft portion from a transverse direction. For example, the removable shim may be a c-shaped removable shim. This has been found to facilitate insertion and removal of the removable shim in a transverse direction. That is, in a direction transverse to the longitudinal axis of the removable shim. In other examples, the removable shim may have a closed shape which defines a central opening within which the shaft portion of the pivot post may be received, for example by inserting an end surface of the shaft portion through the central opening.

Preferably, the open shape defines an opening having a width which is no less than the diameter of the shaft portion of the pivot post. With this arrangement, the shim can be placed around the shaft portion without the need to deform the shim, either elastically or plastically. This avoids any risk that the dimensions of the shim may be altered during insertion, thereby unintentionally changing the amount of lash provided by the shim. In other examples, the opening may have a width which is less than the diameter of the shaft portion. In such examples, the shim must be expanded when inserted around the shaft portion.

The pivot post may comprise a shaft portion and a shoulder portion. Preferably, the removable shim is disposed between the bearing surface of the fixed body and a shoulder portion of the pivot post. The shoulder portion extends in a transverse direction from the shaft portion. In this manner, the removable shim is sandwiched between the shoulder portion and the bearing surface during use.

In any of the above embodiments, the pivot post may comprise one or more protrusions, recesses, or apertures by which the pivot post can be manually lifted, for example using a specially adapted tool.

Where the pivot post comprises a shoulder portion, preferably, the shoulder portion comprises a recess on its radially outer surface by which the pivot post can be manually lifted, for example using a specially adapted tool. This is been found to provide a particularly convenient means by which the pivot post can be grasped.

Preferably, the shoulder portion comprises an annular flange extending around the shaft portion and the recess comprises an annular groove on the radially outer surface of the annular flange. The shoulder portion may comprise a flange extending around only part of the circumference of the shaft portion.

Preferably, the bearing surface of the fixed body comprises a rebate within which the removable shim is at least partially received. The rebate, or recess, may be configured to constrain movement of the removable shim relative to the fixed body in at least one transverse direction. This facilitates retention of the removable shim.

Preferably, the rebate has a diameter and shape which corresponds with the diameter and shape of the removable shim. In this manner, the rebate is able to constrain movement of the removable shim relative to the fixed body in any transverse direction. This further facilitates retention of the removable shim. The rebate may have a depth which is less than, equal to, or greater than the thickness of the removable shim. Preferably, the rebate has a diameter which is greater than the maximum diameter of the portion of the pivot post against which the removable shim is disposed, for example greater than the maximum diameter of the shoulder portion of the pivot post. This allows that portion of the pivot post to be at least partly received in the rebate should the valve train require the use of a removable shim having a thickness which is less than the depth of the rebate.

The removable shim is preferably rigid. The removable shim preferably comprises a hardened metal material. The removable shim may comprise one or more of stainless steel, aluminium, copper, and copper alloys. The removable shim preferably comprises a hardened steel material.

According to a second aspect of the present invention, there is provided a kit comprising the marine outboard motor of the first aspect and a specially adapted lifting tool with a grasping portion which is configured to fit against the pivot post such that the pivot post can be moved in the first longitudinal direction with the lifting tool.

This provides a convenient means by which the pivot post can be lifted. The specially adapted lifting tool may have a fixed configuration, such than adjustment of the tool is not required prior to lash adjustment. The grasping portion may be configured to fit against only one side of the pivot post. The grasping portion may be configured to fit against only two opposed sides of the pivot post. The grasping portion may be configured to fit at least partly around the pivot post. The grasping portion may be configured to fit against an internal surface of the pivot post, such as an internal surface defined by an aperture extending through the pivot post.

The grasping portion of the specially adapted lifting tool may be configured to fit against a protrusion extending from an outer surface of the pivot post. The grasping portion may be configured to fit into an aperture extending through the pivot post.

Preferably, the pivot post comprises a recess on its radially outer surface, wherein the grasping portion is configured to be at least partly received in the recess. Where the pivot post comprises a shoulder portion, the recess may be provided on the radially outer surface of the shoulder portion.

Where the pivot post comprises a recess on its radially outer surface, the recess may be provided on a single side of the pivot post. Preferably, the recess is provided on opposite sides of the pivot post. Preferably, the opposite sides are diametrically opposed. The recess may circumscribe the pivot post. The recess may be an annular groove which circumscribes the pivot post. The recess may be discontinuous. The grasping portion preferably comprises at least two prongs which are spaced apart such that each prong can be received simultaneously in the recess on opposite side of the pivot post. For example, the grasping portion may have two substantially parallel prongs.

According to a third aspect of the present invention, there is provided a marine vessel comprising the marine outboard motor of the first aspect.

The fixed body from which the pivot post extends may comprise any suitable part of the engine block. Preferably, the fixed body comprises part of a cylinder head of the engine block.

The engine block may comprise a single cylinder. Preferably, the engine block comprises a plurality of cylinders.

As used herein, the term "engine block" refers to a solid structure in which at least one cylinder of the engine is provided. The term may refer to the combination of a cylinder block with a cylinder head and crankcase, or to the cylinder block only. The engine block may be formed from a single engine block casting. The engine block may be formed from a plurality of separate engine block castings which are connected together, for example using bolts.

The engine block may comprise a single cylinder bank.

The engine block may comprise a first cylinder bank and a second cylinder bank. The first and second cylinder banks may be arranged in a V configuration.

The engine block may comprise three cylinder banks. The three cylinder banks may be arranged in a broad arrow configuration. The engine block may comprise four cylinder banks. The four cylinder banks may be arranged in a W or double-V configuration.

The internal combustion engine may be arranged in any suitable orientation. Preferably, the internal combustion engine is a vertical axis internal combustion engine. In such an engine, the internal combustion engine comprises a crankshaft which is mounted vertically in the engine.

The internal combustion engine may be a petrol engine. Preferably, the internal combustion engine is a diesel engine. The internal combustion engine may be a turbocharged diesel engine.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. In particular, features of the first aspect of the invention are equally applicable to the kit of the second aspect of the invention, to the marine vessel of the third aspect of the invention, and vice versa. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

Further features and advantages of the present invention will be further described below, by way of example only, with reference to the accompanying drawings in which.

DETAILED DESCRIPTION

Figure 1:
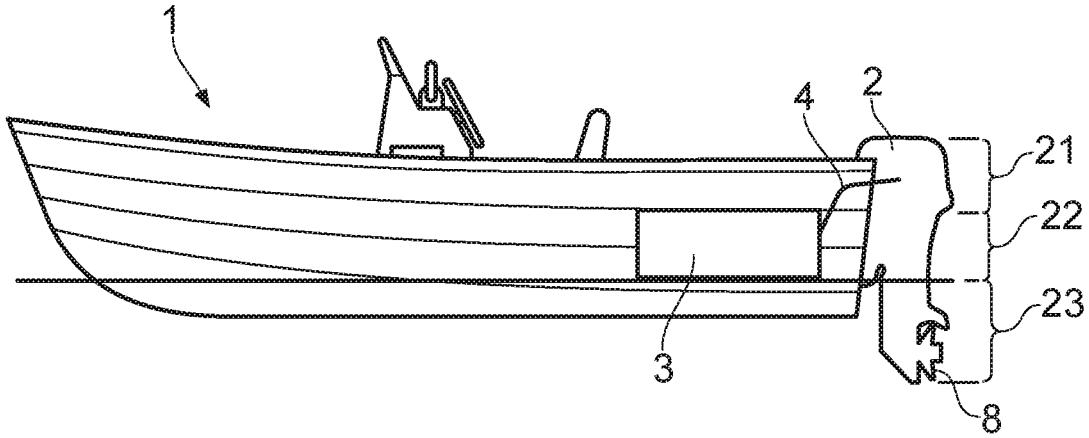
FIG. 1 is a schematic side view of a light marine vessel provided with a marine outboard motor.

Referring firstly to FIG. 1, there is shown a schematic side view of a marine vessel 1 with a marine outboard motor 2. The marine vessel 1 may be any kind of vessel suitable for use with a marine outboard motor, such as a tender or a scuba-diving boat. The marine outboard motor 2 shown in FIG. 1 is attached to the stern of the vessel 1. The marine outboard motor 2 is connected to a fuel tank 3, usually received within the hull of the marine vessel 1. Fuel from the reservoir or tank 3 is provided to the marine outboard motor 2 via a fuel line 4. Fuel line 4 may be a representation for a collective arrangement of one or more filters, low pressure pumps and separator tanks (for preventing water from entering the marine outboard motor 2) arranged between the fuel tank 3 and the marine outboard motor 2.

As will be described in more detail below, the marine outboard motor 2 is generally divided into three sections, an upper-section 21, a mid-section 22, and a lower-section 23. The mid-section 22 and lower-section 23 are often collectively known as the leg section, and the leg houses the exhaust system. A propeller 8 is rotatably arranged on a propeller shaft at the lower-section 23, also known as the gearbox, of the marine outboard motor 2. Of course, in operation, the propeller 8 is at least partly submerged in water and may be operated at varying rotational speeds to propel the marine vessel 1.

Typically, the marine outboard motor 2 is pivotally connected to the stern of the marine vessel 1 by means of a pivot pin. Pivotal movement about the pivot pin enables the operator to tilt and trim the marine outboard motor 2 about a horizontal axis in a manner known in the art. Further, as is well known in the art, the marine outboard motor 2 is also pivotally mounted to the stern of the marine vessel 1 so as to be able to pivot, about a generally upright axis, to steer the marine vessel 1.

Tilting is a movement that raises the marine outboard motor 2 far enough so that the entire marine outboard motor 2 is able to be raised completely out of the water. Tilting the marine outboard motor 2 may be performed with the marine outboard motor 2 turned off or in neutral. However, in some instances, the marine outboard motor 2 may be configured to allow limited running of the marine outboard motor 2 in the tilt range so as to enable operation in shallow waters. Marine engine assemblies are therefore predominantly operated with a longitudinal axis of the leg in a substantially vertical direction. As such, a crankshaft of an engine of the marine outboard motor 2 which is substantially parallel to a longitudinal axis of the leg of the marine outboard motor 2 will be generally oriented in a vertical orientation during normal operation of the marine outboard motor 2, but may also be oriented in a non-vertical direction under certain operating conditions, in particular when operated on a vessel in shallow water. A crankshaft of a marine outboard motor 2 which is oriented substantially parallel to a longitudinal axis of the leg of the engine assembly can also be termed a vertical crankshaft arrangement. A crankshaft of a marine outboard motor 2 which is oriented substantially perpendicular to a longitudinal axis of the leg of the engine assembly can also be termed a horizontal crankshaft arrangement.

Figure 2A:
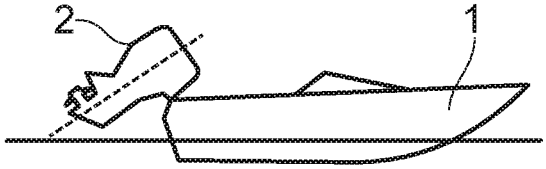
FIG. 2A shows a schematic representation of a marine outboard motor in its tilted position.

As mentioned previously, to work properly, the lower-section 23 of the marine outboard motor 2 needs to extend into the water. In extremely shallow waters, however, or when launching a vessel off a trailer, the lower-section 23 of the marine outboard motor 2 could drag on the seabed or boat ramp if in the tilted-down position. Tilting the marine outboard motor 2 into its tilted-up position, such as the position shown in FIG. 2A, prevents such damage to the lower-section 23 and the propeller 8.

Figure 2B:
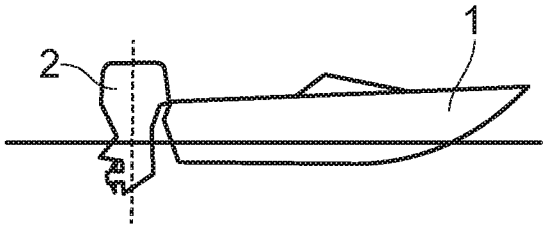
FIGS. 2B to 2D show various trimming positions of the marine outboard motor and the corresponding orientation of the marine vessel within a body of water.
Figure 2C:
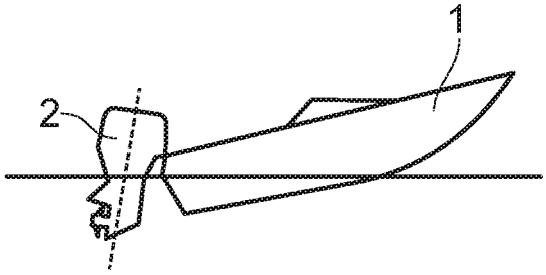
Figure 2D:
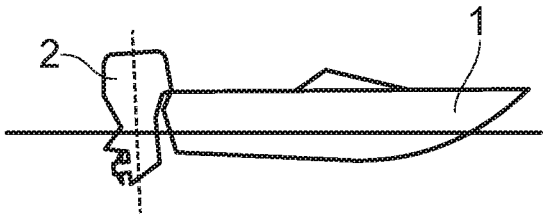

By contrast, trimming is the mechanism that moves the marine outboard motor 2 over a smaller range from a fully-down position to a few degrees upwards, as shown in the three examples of FIGS. 2B to 2D. Trimming helps to direct the thrust of the propeller 8 in a direction that will provide the best combination of fuel efficiency, acceleration and high speed operation of the marine vessel 1.

When the vessel 1 is on a plane (i.e. when the weight of the vessel 1 is predominantly supported by hydrodynamic lift, rather than hydrostatic lift), a bow-up configuration results in less drag, greater stability and efficiency. This is generally the case when the keel line of the boat or marine vessel 1 is up about three to five degrees, such as shown in FIG. 2B for example.

Too much trim-out puts the bow of the vessel 1 too high in the water, such as the position shown in FIG. 2C. Performance and economy, in this configuration, are decreased because the hull of the vessel 1 is pushing the water and the result is more air drag. Excessive trimming-out can also cause the propeller to ventilate, resulting in further reduced performance. In even more severe cases, the vessel 1 may hop in the water, which could throw the operator and passengers overboard.

Trimming-in will cause the bow of the vessel 1 to be down, which will help accelerate from a standing start. Too much trim-in, shown in FIG. 2D, causes the vessel 1 to "plough" through the water, decreasing fuel economy and making it hard to increase speed. At high speeds, trimming-in may even result in instability of the vessel 1.

Figure 3:
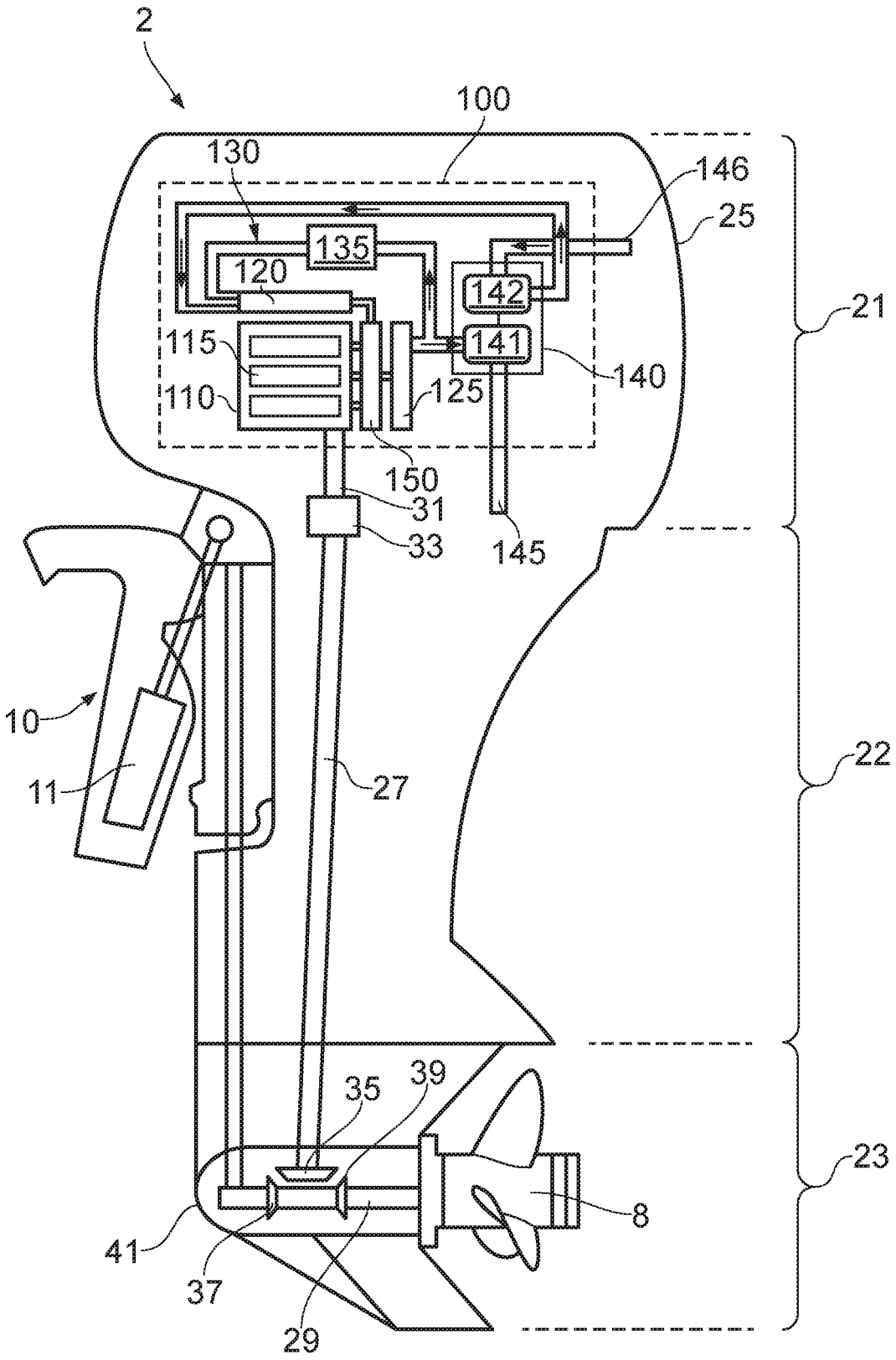
FIG. 3 shows a schematic cross-section of a marine outboard motor according to an embodiment of the present invention.

Turning to FIG. 3, there is shown a schematic cross-section of an outboard motor 2 according to an embodiment of the present invention. The outboard motor 2 comprises a tilt and trim mechanism 10 for performing the aforementioned tilting and trimming operations. In this embodiment, the tilt and trim mechanism 10 includes a hydraulic actuator 11 that can be operated to tilt and trim the outboard motor 2 via an electric control system. Alternatively, it is also feasible to provide a manual tilt and trim mechanism, in which the operator pivots the outboard motor 2 by hand rather than using a hydraulic actuator.

As mentioned above, the outboard motor 2 is generally divided into three sections. An upper-section 21, also known as the powerhead, includes an internal combustion engine 100 for powering the marine vessel 1. A cowling 25 is disposed around the engine 100.

Adjacent to, and extending below, the upper-section 21 or powerhead, there is provided a mid-section 22 and a lower section 23. The lower-section 23 extends adjacent to and below the mid-section 22, and the mid-section 22 connects the upper-section 21 to the lower-section 23. Together, the mid-section 22 and the lower section 23 form the leg section of the marine outboard motor 2. The mid-section 22 houses a drive shaft 27 which extends in a vertical direction between the combustion engine 100 and the propeller shaft 29 and is connected to a crankshaft 31 of the combustion engine via a floating connector 33 (e.g. a splined connection). At the lower end of the drive shaft 27, a gear box/transmission is provided that supplies the rotational energy of the drive shaft 27 to the propeller 8 in a horizontal direction. In more detail, the bottom end of the drive shaft 27 may include a bevel gear 35 connected to a pair of bevel gears 37, 39 that are rotationally connected to the propeller shaft 29 of the propeller 8. The propeller shaft 29 and bevel gears 37, 39 are housed in a torpedo-shaped gear casing 41 at the lower end of the lower section 23.

The mid-section 22 and lower-section 23 form an exhaust system, which defines an exhaust gas flow path for transporting exhaust gases from an exhaust gas outlet 170 of the internal combustion engine 100 and out of the outboard motor 2.

As shown schematically in FIG. 3, the internal combustion engine 100 includes an engine block 110 having a plurality of cylinders 115 in each of which a combustion chamber is defined, an air intake manifold 120 for delivering a flow of air to the cylinder 115 in the engine block, and an exhaust manifold 125 configured to direct a flow of exhaust gas from the cylinder 115. The engine 100 further includes a valve train 150 by which the opening and closing of the combustion chamber is controlled to allow flows of intake air and exhaust gases into and out of the combustion chamber. The valve train 150 is discussed in more detail in relation to FIG. 4. In this example, the engine 100 further includes an optional exhaust gas recirculation (EGR) system 130 configured to recirculate a portion of the flow of exhaust gas from the exhaust manifold 125 to the air intake manifold 120. The EGR system includes a heat exchanger 135, or "EGR cooler", for cooling recirculated exhaust gas. The internal combustion engine 100 is turbocharged and so further includes a turbocharger 140 connected to the exhaust manifold 125 and to the air intake manifold 120. In use, exhaust gases are expelled from each cylinder in the engine block 110 and are directed away from the engine block 110 by the exhaust manifold 125. Where the engine includes an EGR system 130, a portion of the exhaust gases may be diverted to the heat exchanger 135 when exhaust gas recirculation is required. The remaining exhaust gases are delivered from the exhaust manifold 125 to a turbine housing 141 of the turbocharger 140 where they are directed through the turbine before exiting the turbocharger 140 and the engine 100 via the engine exhaust outlet 145. The compressor housing 142 of the turbocharger, which is driven by the spinning turbine, draws in ambient air through an air intake 146 and delivers a flow of pressurised intake air to the air intake manifold 120. The engine 100 also includes an engine lubrication fluid circuit, to lubricate moving components in the engine block, and a turbocharger lubrication system (not shown in FIG. 3).

Figure 4:
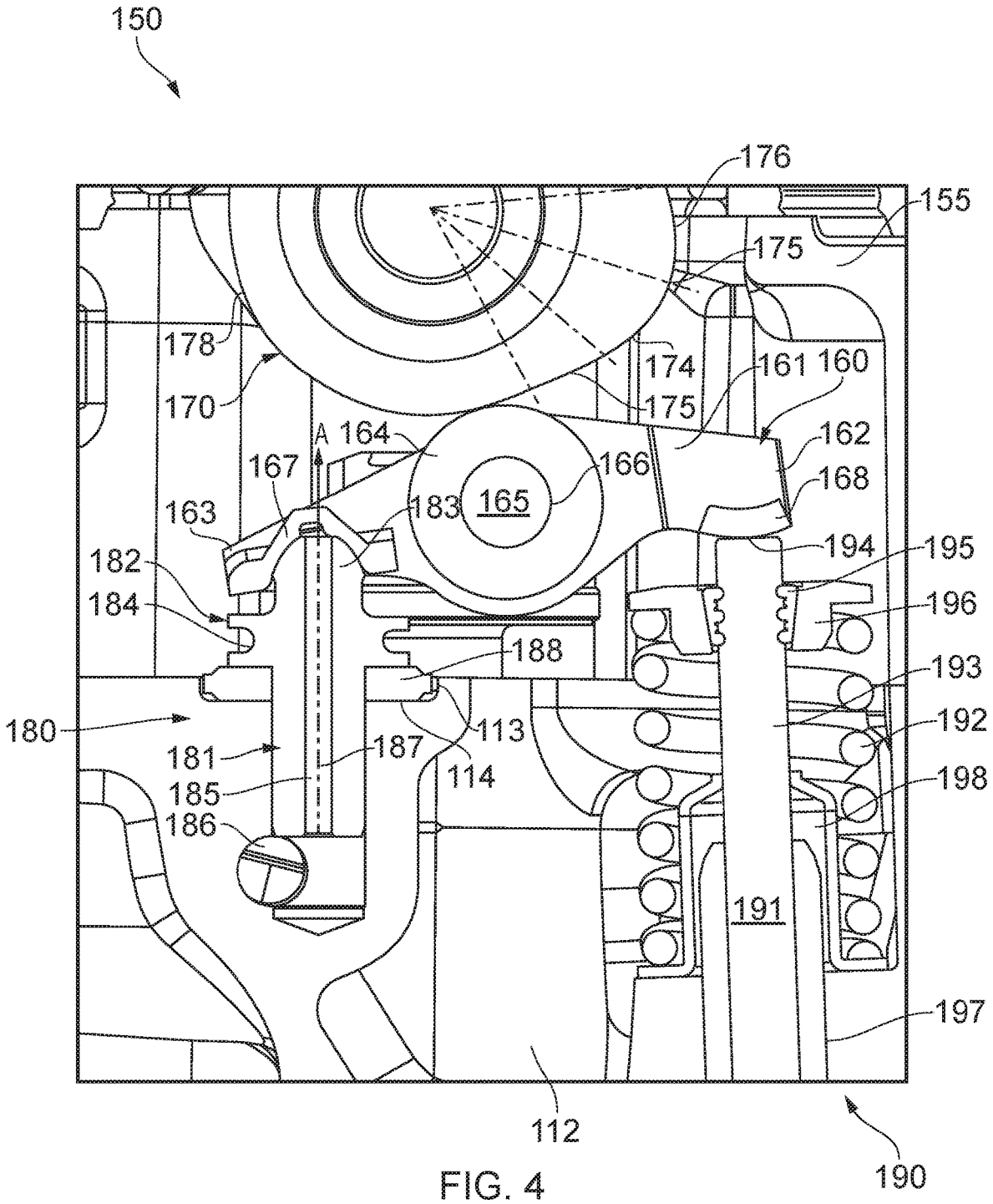
FIG. 4 shows an enlarged cross-sectional view of part of the valve train of the internal combustion engine of the marine outboard motor of FIG. 3.

FIG. 4 shows an enlarged cross-sectional view of part of the valve train 150 of the internal combustion engine 100 of FIG. 3. The valve train 150 includes a roller finger follower 160, a cam 170, a pivot post 180, and a valve assembly 190. The components of the valve train 150 are enclosed within a cam cover 155 mounted to the cylinder head 112 of the engine block. The roller finger follower 160 has an elongate body 161 with a valve end 162 and a pivot end 163. A roller 164 is rotatably mounted on the elongate body 161 by a shaft 165 located in a bore 166 between the valve end 162 and the pivot end 163. The pivot end 163 of the elongate body 161 has a curved recess 167 on its underside. The valve end 162 of the elongate body 161 has an outwardly curved stem contact surface 168 on its underside. The cam 170 has a cam lobe 171 and a heel 178. The heel 178 forms the base circle of the cam 170. The cam lobe 171 forms a convex protrusion on the cam surface and is defined by an opening ramp 172, an opening flank 173, a nose 174, a closing flank 175, and a closing ramp (not shown). The cam lobe 171 is configured to contact the roller 164 to displace the elongate body 161 and thereby operate the valve assembly 190. The cam 170 is fixed to a rotatable cam shaft 177.

The pivot post 180 includes a shaft portion 181 and a shoulder portion 182 at the upper end of the shaft portion 181 which extends in a transverse direction from the shaft portion 181. The upper end of the pivot post 180 comprises a curved head 183 which defines a contact surface about which the roller finger follower pivots when deflected by the cam during operation. The curved head 183 of the pivot post 180 is received in the curved recess 167 of the roller finger follower 160. The curved recess 167 and the curved head 183 may each be spherical. Within the pivot post is an oil channel 185 which extends from an oil gallery 186 to the curved head 183 to provide a flow of oil to lubricate the curved head 183 and the curved recess 167 during operation. The shoulder portion 182 has a recess in the form of an annular groove 184 on its radially outer surface. The shaft portion 181 extends from a bore 111 in the cylinder head 112 of the engine block. The cylinder head 112 is a fixed body of the engine block in that it is fixed in position relative to the engine block. The shaft portion 181 is slidably received in the bore 111 such that the pivot post is moveable relative to the cylinder head 112 in a first longitudinal direction away from the cylinder head 112 along the longitudinal axis 187 of the shaft portion 181, as indicated by arrow A. The cylinder head 112 includes a rebate 113 on its upper surface. The rebate 113 defines a bearing surface 114 which faces the underside of the shoulder portion 182 of the pivot post. A removable shim 188 with an open shape is disposed around the upper end of the shaft portion 181 and is sandwiched between the shoulder portion 182 and the bearing surface 114. In this manner, the shoulder portion 182 is spaced from the cylinder head 112 in the first longitudinal direction by a clearance which equates to the thickness of the removable shim 188. Preferably, the open shape of the removable shim 188 defines an opening (not shown) having a width which is no less than the diameter of the shaft portion 181 of the pivot post 180. In this manner, the removable shim 118 may be positioned around the shaft portion 181 without needing to be deflected or deformed. The removable shim 188 may have an outer diameter which corresponds to the diameter of the rebate 113, so that the removable shim 188 is constrained in a transverse direction relative to the cylinder head 112.

The valve assembly 190 includes a poppet valve 191 and a valve spring 192 configured to bias the poppet valve 191 towards a closed position. As with conventional valve assemblies, the poppet valve is formed from a valve stem 193 and a valve head (not shown) configured to fit against a valve seat (not shown) of a port in the cylinder head 112 when in a closed position. The valve stem 193 has a hardened tip 194 and is connected to the valve spring 192 by a collet 195 and a retainer 196 at the upper end of the valve spring 192 and adjacent to the stem tip 194. The valve stem 193 is slidably supported within a valve guide 197 in the cylinder head 112. A valve stem seal 198 is provided at the base of the valve spring 192 and extends around the valve stem 193 and the valve guide 197 to prevent oil from entering the combustion chamber. The valve stem seal 198 also helps to lubricate the valve stem 193 and the valve guide 197 with oil to facilitate relative movement between these components.

During operation, rotation of the cam shaft 177 causes the cam lobe 171 to press down on the roller 164, firstly with the opening ramp 172, then with the opening flank 173 and the nose 174 in order to open the valve 191. When the roller 164 is pressed down by the cam lobe 171, the elongate body 161 is pivoted towards the cylinder head 112 about the contact surface between the curved recess 167 and the curved head 183 of the pivot post 180. This causes the stem contact surface 168 at the valve end 162 of the roller finger roller 160 to force the tip 194 of the valve stem 193 downwards against the action of the valve spring 192 to open the valve. The valve 191 is fully open when the nose 174 of the cam lobe 171 is in contact with the roller 164. To close the valve, continued rotation of the cam shaft 177 brings the closing flank 175 and then the closing ramp into contact with the roller 164. This allows the roller finger follower 160 to be pivoted away from the cylinder head 112 by the valve spring 192 via the stem tip 194 and the stem contact surface 168. As will be understood, the maximum displacement, or "lift", of the valve 191 is determined by the geometry of the nose 174, while the acceleration of the valve 191 is determined by the geometry of the ramps and flanks and by the speed of rotation of the cam shaft 177.

When the engine is cold, a design clearance or "lash" exists between the roller 164 and the heel 178 of the cam 170 to compensate for changes in the length of components of the valve train due to heat expansion during use and due to wear. If the lash is too small, the valve head might not seat properly in the closed position when the engine is hot. If the lash is too large, a clearance might exist between roller 164 and the opening and closing ramps, leading to excessive valve acceleration. This can cause noise and durability issues. The amount of lash can also vary over the life of the engine due to wear. Consequently, it is important to periodically ensure that the correct amount of lash is present in the valve train.

With the arrangement shown in FIG. 4, the lash can be adjusted as follows. Firstly, with the roller on the base circle portion of the cam, the existing lash between the roller 164 and the cam 170 is measured, for example using a feeler gauge. If lash adjustment is required, the pivot post 180 is lifted in the first longitudinal direction A away from the cylinder head 112 to compress the valve spring 192 with the elongate body 161 of the roller finger follower 160. This temporarily introduces a clearance between the removable shim 188 and the shoulder portion 182 of the pivot post 180 to allow the removable shim 188 to be removed from around the shaft portion 181. A replacement removable shim is then selected based on its thickness and the required lash, and is inserted around the shaft portion 181 beneath the shoulder portion 182. Once the replacement shim is in place, the pivot post 180 is released and is moved in the opposite direction by expansion of the valve spring 192, locking the replacement shim into place between the shoulder portion 182 and the bearing surface 114 under the action of the valve spring 192. The difference in thickness between the removable shims means that the pivot post 180 returns to a slightly different position to change the position of the roller finger follower 160 relative to the cam 170. The clearance between the roller 164 and the cam 170 can then be measured to confirm whether the correct lash is present. If not, the process can be repeated easily until a replacement shim has been inserted which provides the correct amount of lash. This means that the lash can be easily adjusted without the need to remove any components of the valve train or valve assembly and without risking losing any components of the valve train, such as valve collets. As will be understood, lash may be increased by inserting a thinner removable shim and may be decreased by inserting a thicker removable shim.

Figure 5:
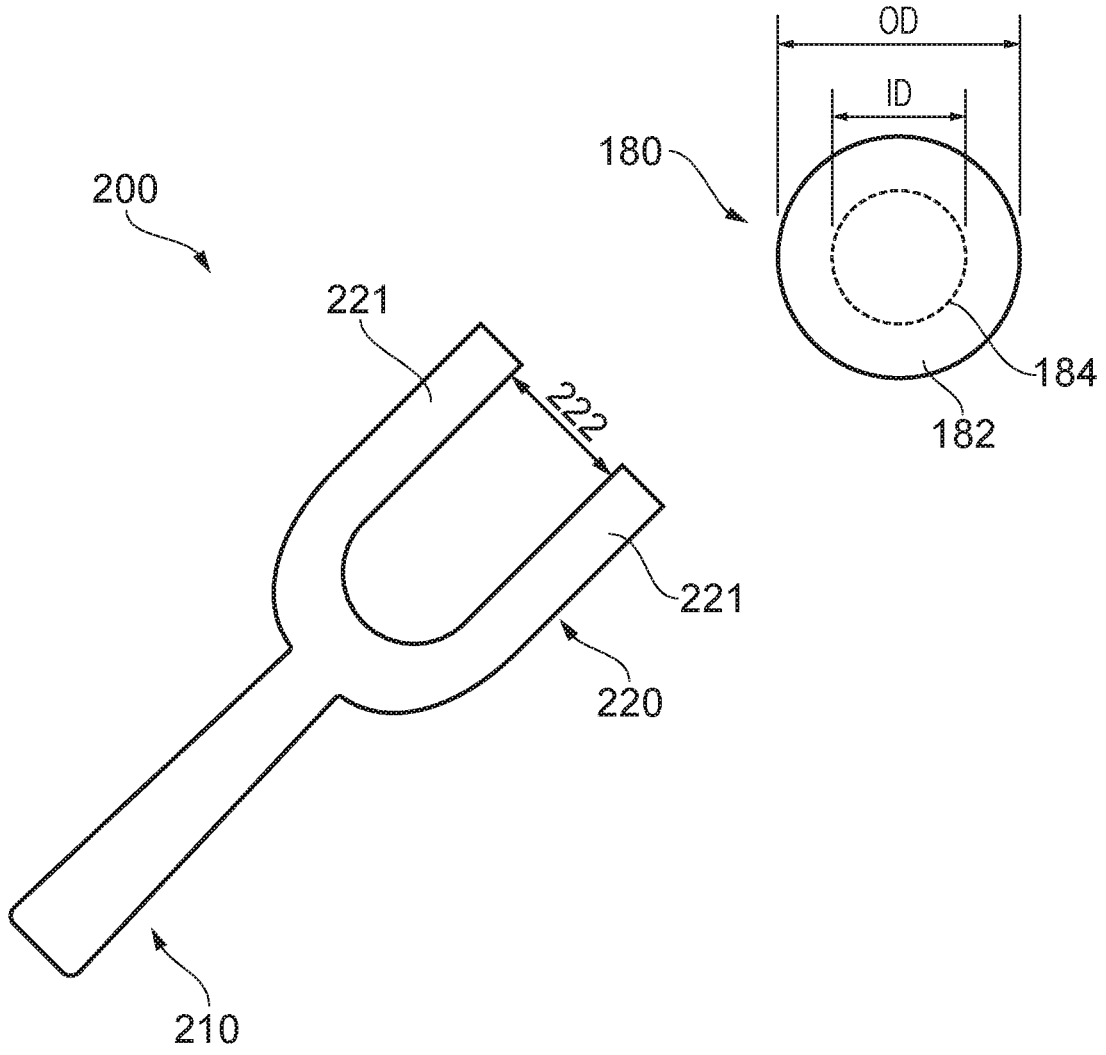
FIG. 5 shows a plan view of a specially adapted lifting tool for use with the valve train of FIG. 4, along with the pivot post of the valve train of FIG. 4.

FIG. 5 illustrates a specially adapted lifting tool 200 for lifting the pivot post 180 of the valve train 150. The lifting tool 200 has a handle portion 210 and a grasping portion 220. In this example, the grasping portion 220 comprises two parallel prongs 221 which are spaced apart by a clearance 222. The clearance 222 should be less than the outer diameter OD of the shoulder portion 182 but greater than the minimum diameter ID of the annular groove 184 defined in the radially outer surface of the shoulder portion 182. In this manner, each prong can be received simultaneously in the annular groove 184 on opposite sides of the pivot post 180 without the need for any adjustment of the lifting tool 200. The pivot post 180 can then be conveniently lifted away from the cylinder head manually by moving the lifting tool 200 in the first longitudinal direction to allow the removable shim to be removed and replaced.

Although the invention has been described above with reference to one or more preferred embodiments, it will be appreciated that various changes or modifications may be made without departing from the scope of the invention as defined in the appended claims.

The invention claimed is:

1. A marine outboard motor having an internal combustion engine comprising:

an engine block having at least one cylinder; and a valve train comprising:

a cam;

a valve assembly including a valve and a valve spring configured to bias the valve towards a closed position;

a roller finger follower having a valve end and a pivot end; and a pivot post extending from a fixed body of the engine block at the pivot end of the roller finger follower, the pivot post defining a contact surface about which the roller finger follower pivots when deflected by the cam during use;

wherein the pivot post is moveable relative to the fixed body in a first longitudinal direction against the action of the valve spring, and wherein a removable shim is disposed between a bearing surface of the fixed body and a portion of the pivot post to space the pivot post from the fixed body in the first longitudinal direction and thereby reduce an amount of lash between the cam and the roller finger follower, wherein the removable shim is dimensioned to fit at least partly around a shaft portion of the pivot post, and wherein the removable shim has an open shape defining an opening having a width which is no less than the diameter of the shaft portion of the pivot post to allow the removable shim to be positioned around the shaft portion from a transverse direction to adjust the amount of lash between the cam and the roller finger follower.

2. The marine outboard motor of claim 1, wherein the removable shim is disposed between the bearing surface of the fixed body and a shoulder portion of the pivot post.

3. The marine outboard motor of claim 2, wherein the shoulder portion comprises a recess on its radially outer surface by which the pivot post can be manually lifted.

4. The marine outboard motor of claim 3, wherein the shoulder portion comprises an annular flange extending around the shaft portion and the recess comprises an annular groove on the radially outer surface of the annular flange.

5. The marine outboard motor of claim 1, wherein the bearing surface of the fixed body comprises a rebate within which the removable shim is at least partially received, the rebate being configured to constrain movement of the removable shim relative to the fixed body in at least one transverse direction.

6. The marine outboard motor of claim 5, wherein the rebate has a diameter and shape which corresponds with the diameter and shape of the removable shim.

7. The marine outboard motor of claim 1, wherein the removable shim comprises a hardened steel material.

8. A kit comprising the marine outboard motor of claim 1 and a specially adapted lifting tool with a grasping portion which is configured to fit against the pivot post such that the pivot post can be moved in the first longitudinal direction with the lifting tool.

9. The kit of claim 8, wherein the pivot post comprises a recess on its radially outer surface, and wherein the grasping portion is configured to be at least partly received in the recess.

10. The kit of claim 9, wherein the recess is provided on opposite sides of the pivot post, and wherein the grasping portion comprises at least two prongs which are spaced apart such that each prong can be received in the recess on opposite side of the pivot post.

11. A marine vessel comprising the marine outboard motor of claim 1.

* * * * *